US006896642B1

(12) United States Patent
Brown

(10) Patent No.: US 6,896,642 B1
(45) Date of Patent: May 24, 2005

(54) MARTIAL ARTS BOARD HOLDING DEVICE AND MOUNTING SYSTEM

(76) Inventor: Jeffrey Brown, 1894 W. El Norte Pkwy., Escondido, CA (US) 92026

( * ) Notice: Subject to any disclaimer, the term of this patent is extended or adjusted under 35 U.S.C. 154(b) by 221 days.

(21) Appl. No.: 10/097,849

(22) Filed: Mar. 14, 2002

Related U.S. Application Data

(60) Provisional application No. 60/276,544, filed on Mar. 15, 2001.

(51) Int. Cl.[7] ..... A63B 21/00
(52) U.S. Cl. ..... 482/83; 482/84; 248/316.4; 248/201
(58) Field of Search ..... 25/3; 404/118; 269/6, 215, 71; 81/177.2, 177.7, 487; 482/83–90; 248/316.4, 201

(56) References Cited

U.S. PATENT DOCUMENTS

| | | | | |
|---|---|---|---|---|
| 1,319,900 A | * | 10/1919 | Reeder | |
| 4,583,730 A | | 4/1986 | Gecht et al. | |
| 4,732,378 A | | 3/1988 | LeFebvre et al. | |
| 4,757,989 A | | 7/1988 | Bauer, Jr. | |
| 4,776,584 A | | 10/1988 | Tilley et al. | |
| 4,787,625 A | | 11/1988 | Chaloux | |
| 4,883,635 A | | 11/1989 | Goradesky | |
| 4,889,334 A | | 12/1989 | Partlo | |
| 5,362,289 A | * | 11/1994 | Holt | 482/83 |
| 5,415,371 A | | 5/1995 | Kirchner | |
| 5,476,433 A | * | 12/1995 | Bruner | 482/87 |
| 5,665,035 A | * | 9/1997 | Tumminia | 482/83 |
| 6,217,490 B1 | * | 4/2001 | Wurtak | |

* cited by examiner

*Primary Examiner*—Jerome W. Donnelly
(74) *Attorney, Agent, or Firm*—Donn K. Harms

(57) ABSTRACT

A practice board holder for use in combination with a martial arts practice board having side edges of substantially equal thickness or having formed depressions in both side edges. The device in one embodiment features tapered handles to improve grip and cooperatively slots for engagement the side edges of conventional martial arts practice boards. Further increase in grip of the board is provided by location of the cleats in the slots which frictionally engages depressions in the side edges of the practice board. The device in another embodiment also employs a pointed piercing cleat to engage practice boards by piercing the side edge and may also be used as a kit in combination with handle mounts and a belt to attach to a conventional heavy punching bag. Additional utility is provided by handle mounts which allow for attachment of the board holders to a wall mounted or swivel mounted rail.

20 Claims, 3 Drawing Sheets

MARTIAL ARTS BOARD HOLDING DEVICE AND MOUNTING SYSTEM

This application claims the benefit of U.S. Provisional Application No. 60/276,544 filed on Mar. 15, 2001.

BACKGROUND OF THE INVENTION

1. Field of the Invention

The present invention relates to an improved device for holding board targets. More particularly it relates to a device which allows for hand holding of a martial arts kick practice board, in a position and manner to avoid injury to the holder as well as a mounting device which may be employed as a kit allowing the target board to be either hand held, bag held, or wall held, using one or a combination of mounting kit parts.

2. Prior Art

Martial arts has become a popular discipline on a world wide basis and is especially popular in the United States as a form of sport for physical exercise and also as a discipline to be learned for mental exercise. The ability of students and masters of the martial arts to focus the force of their punches and kicks is most important. This ability may be practiced in the mind and on phantom boards to obtain muscle memory of the required movements of body and legs. However, in order to master the various kicks and punches in a fashion that recreates real world uses, and to allow the student or master to practice their energy focus and to feel the results of focused force of a kick or punch, the breaking of boards is commonly employed. In use, one or a plurality of such boards are held at the proper level and distance as a target for the person to practice upon. The boards are conventionally held by another student or teacher in the hands which can lead to serious physical injury to the holder should the punch or kick hitting the practice board be off target. This is especially true when the target board is held in the hands of the assisting party which exposes the fingers of the holder to the foot or fist of the practicing student or demonstrating master of the martial art being practiced.

Currently popular for practice punching and kicking is the employment of plastic reusable boards which are manufactured with a breakable center seam that is engineered to give and break when struck with sufficient force and sufficiently on target. Such practice boards generally are of a hollow core plastic material with a tongue and groove center seam designed with the intended breaking qualities to yield to the appropriately landed blow is of sufficient force and on target.

However, as in the use of real wood boards, the holder does so at his peril should the practicing student miss the center and strike the holders fingers. Further, because of the angle of the hands and arms of the holder during such striking sessions, even if the practicing party is on target, the force transmitted by the board end to the awkwardly angled arms, hands, and wrists, of a holder can also cause injury to the holder. Various patents have attempted to address some of these hazards.

U.S. Pat. No. 4,732,378 (LeFebvre) teaches a portable karate kick board holder. However the device is bulky, and gripping its handles still leaves the holder with angles of the hand to forearm that are not the best to avoid injury.

U.S. Pat. No. 4,776,584 (Tilley) teaches a clamping type device for holding a board. However Tilley employs rubber clamps which must be threaded about the intended board and fails to provide a grip for the holder which will minimize potential injury from transmitted force.

U.S. Pat. No. 5,415,371 (Kirchner) teaches a wall mounted pipe which provides a mount for two arms which hold the board directly in front of the pipe. While there is no potential injury to a human holder, the user of this device faces serious injury to the hand or foot should either encounter the steel pipe directly behind the target board.

Thus, there is a continuing need for improvement in devices used in the area of target board holding for martial arts. In particular there is a need for such a device that easily mounts to and dismounts from, the target board, and provides protection from injury to the student as well as the holder.

SUMMARY OF THE INVENTION

The applicant's device is an improved martial arts target board holding device which features an easy attachment of a pair of board holders to existing plastic style kick boards as well as attachment to actual wood boards. The device as herein disclosed features a unique handle extending rearward from cooperatively engaging board slot which provides a grip to the holder that allows the holder to keep the wrists in line with the arms and minimize injuries to the holder from absorbed force. Further, the device features a plurality of ways to actually hold or mount the board holders to a practice bag and to a wall or other solid mount thus allowing the user to practice without the aid of a fellow student or teacher to hold the board.

Easy mounting of the board holders to the intended target board is facilitated by the provision of an elongated board engaging slot affixed substantially perpendicular or normal to a rearward extending handle support. The board engaging slot when used in combination with a conventional hollow core plastic practice board, features a plurality of cooperatively engaging cleats shaped to frictionally engage slots that are in the side edges of such plastic practice boards. When used in combination with a real wood board, the cleats are pointed and the sidewalls of the engaging slot slope toward the center mounted pointed cleat to thereby compress the edge of the board inserted onto the pointed cleat.

Unique to the disclosed device is the employment of a handle which is shaped to allow for a proper grip by the hand of the holder as well as encouraging the holder's hand to the proper angle in relation to the forearm. In the current best mode, the handle has generally rectangular shape about the exterior and the interior features an angled aperture such that the top portion of the gripping handle is thicker than the bottom portion of the gripping handle. This employment of a tapered thickness in the gripping handle of the best embodiment of the disclosed device provides the needed thickness for the upper portion to accommodate the longer fingers and hand portions of the holder when gripping the handle. The angled rear wall and thicker upper portion thus allows for an evenly disbursed grip by the holder on the entire handle for a better grip. Tapering the rear gripping handle naturally encourages the holder's hands to a natural and an inline position with the forearms to absorb the force exerted on the practice board in a better fashion thus avoiding injuries.

In the kit form the device employs the two board mounts with gripping handles to the rear which can be cooperatively engaged with a provided clip and belt which provide a means of attachment of the two board mounts to a heavy bag such as those used in gyms. This allows the user to practice on boards which are mounted upon the bag providing an excellent target and eliminating possible injury to any human holder since none is needed. This is especially useful with novice students who lack focus and accuracy of the force and placement of kicks and punches and are likely to injure human holders.

The kit also provides a wall mounted track which employs mounts for the board mounts which engage registered slots on the edge of the track. The user thus can move the target board to a number of positions on the track and does not need a human holder.

Finally, the holding kit features a mounting bracket that is attached to a conventional swivel type mount allowing the user to mount the practice board in the board mounts on the bracket and swivel the bracket to provide practice for striking at different angles.

Of course use of the hand-held board mounts by themselves is a great improvement to the present art and use of them by themselves or in combination with various kit parts would yield improved function and such individual or combination use is anticipated.

It is an object of this invention to provide board mounts for a martial arts practice board which are easily attachable to the side edge of the practice board intended for use.

Another objective of this invention is to provide such board mounts which provide a gripping handle for the holder which maximizes the ability of their hand to grip the handle as well as encourages good hand to arm positioning to absorb force without injury.

A further objective of this invention is to provide such board mounts which provide a gripping handle which is angled to place the hand of the holder in a natural position in relation to the forearm when holding the board to minimize injuries.

An additional objective of this invention is to provide a martial arts practice board mount that is both hand held and can be attached to a practice bag or wall eliminating the need for a human holder.

Further objectives of this invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF PREFERRED EMBODIMENTS OF THE DISCLOSED DEVICE

Figure 1:
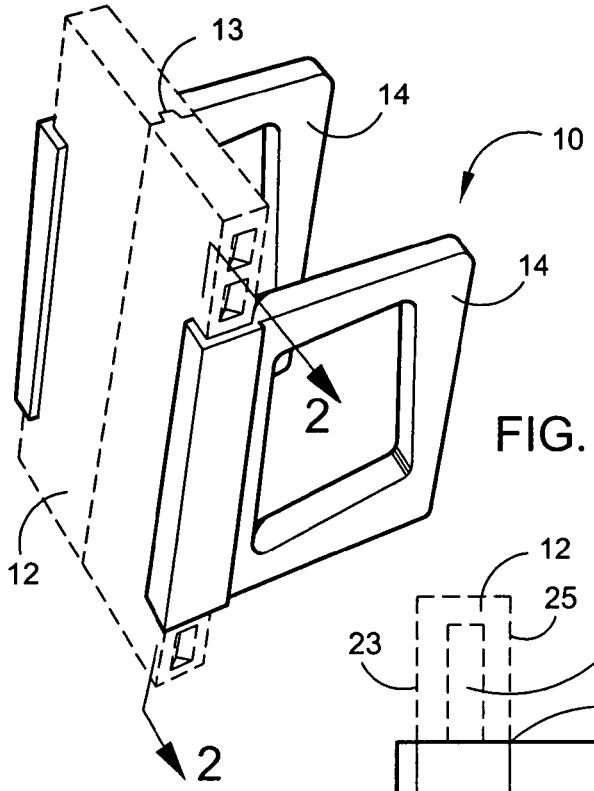
FIG. 1 is a perspective view of the disclosed device featuring a pair of board mounts positioned in cooperative engagement with the edge of a practice board used in combination herewith.
Figure 2:
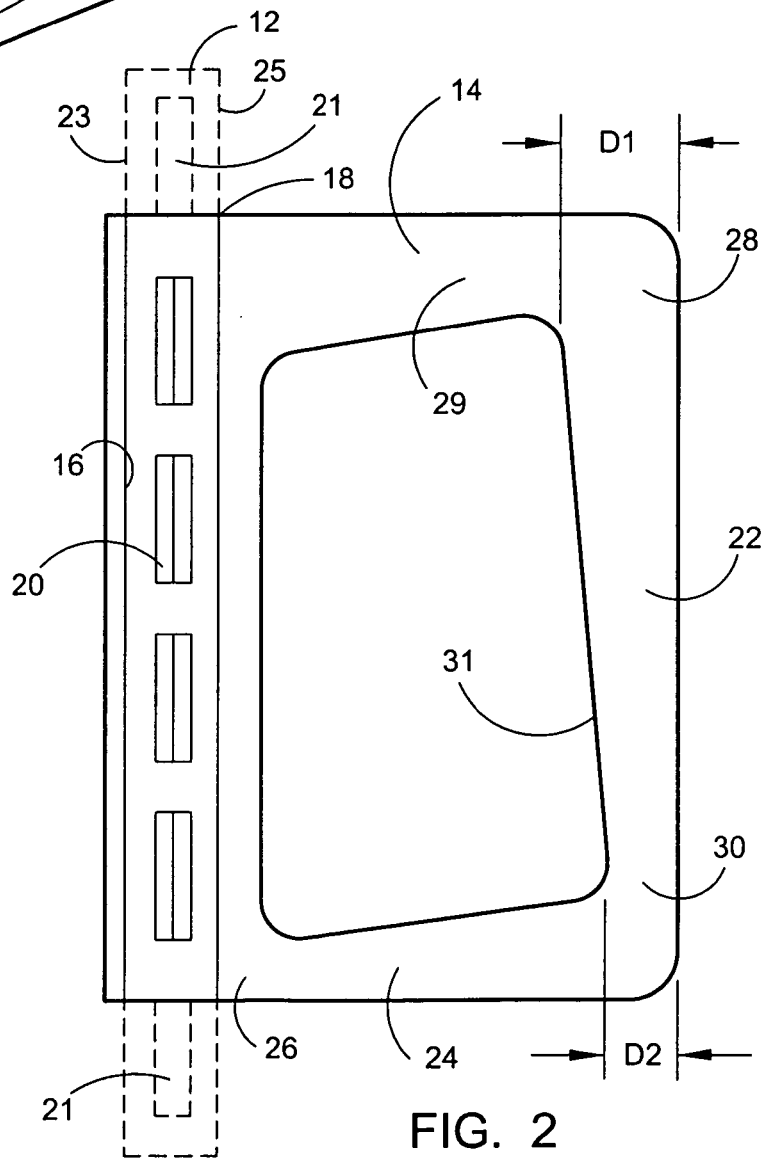
FIG. 2 is a sectional view along line 2—2 of one of the board mounts showing the tapered gripping handle mounted rearward of the elongated slot with cooperatively engaging cleats therein.
Figure 3:
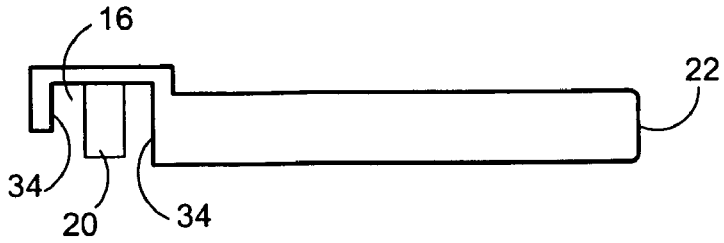
FIG. 3 is an end view of the board mount showing a pointed cooperatively engaging cleat extending upward from the base of the elongated slot.
Figure 4:
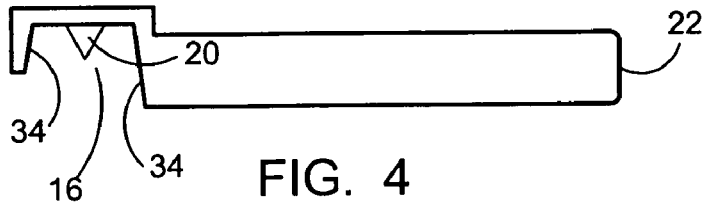
FIG. 4 is an end view of an embodiment of the device for attachment to standard wood boards featuring a slot formed with inwardly tapered sidewalls on the elongated slot to compress the wood which is also engaged on the pointed cleat.
Figure 5:
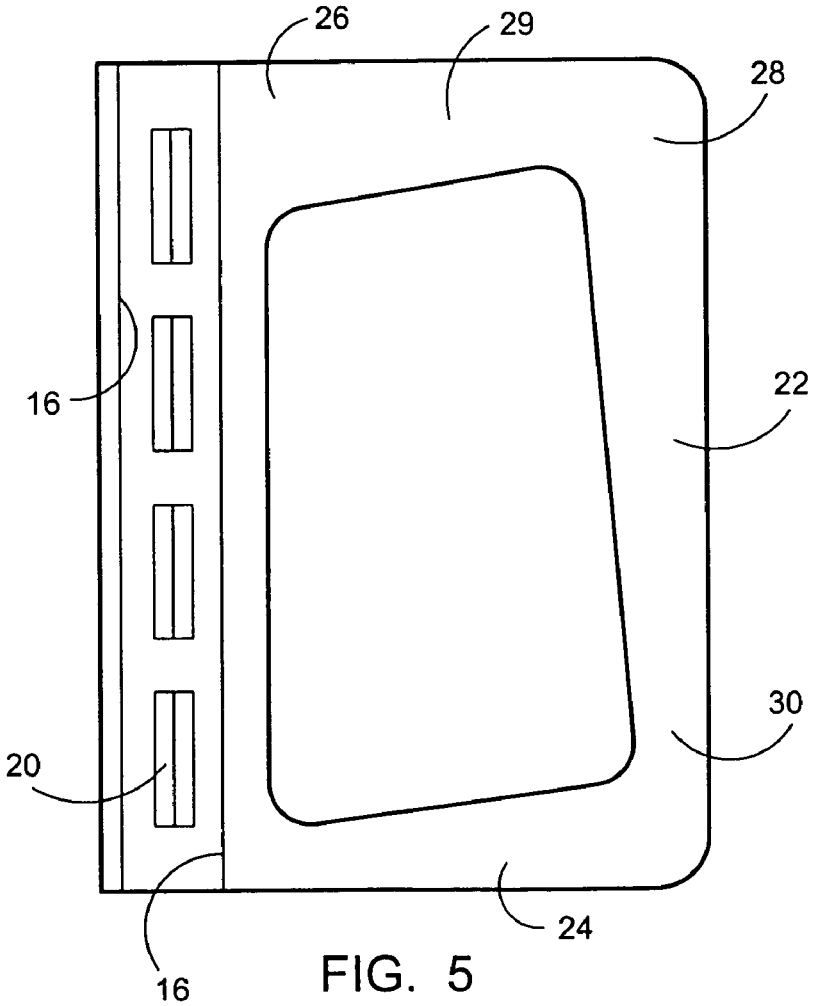
FIG. 5 is a side view of another embodiment of the board mounts showing the inwardly angled rear wall forming the tapered gripping handle mounted rearward of the elongated slot with differently shaped cooperatively engaging cleats therein.

Referring now to the drawings, FIGS. 1–9 disclose an improved martial arts target board mounting device 10 which is used in combination with practice boards 12 of either plastic reusable style, or conventional wood. The device 10 provides an easy means of cooperative engagement with the side edge of kick boards by using pair of board holders 14. The board holders 14 are used in pairs with each configured for easy attachment to such practice boards 12. Such cooperative engagement with the side edge of a conventional plastic practice board 12 is best achieved through the provision of an elongated slot 16 positioned at the front edge 18 of the board holder 14 and sized to accommodate the diameter of the thickness of the intended practice board 12 which is generally substantially equal to the diameter of the board or slightly smaller, to provide a frictional engagement in the slot 16.

In the current best mode for engagement a practice board 12 which is of the conventional plastic construction and having side edges with depressions or apertures therein, at least one cleat 20 is positioned in the slot 16 to cooperatively engage a similarly shaped depression 21 employed along the side edges of most conventional plastic practice boards 12. A plurality of such cleats 20 engaging a plurality of such similarly shaped depressions, 21 would be employed in the current best mode of the device and yielding a means for cooperative frictional engagement of slot 16 with the internal surface of the depressions 21 formed in the sidewall of the board 12. This combination of the frictional engagement of the cleats 20 with the depressions 21 and the slot sidewalls 22 with the front surface 23 and rear surface 25 of the practice board 12 yields an especially solid and secure means of cooperative engagement of the board holder 14 with the practice board 12. The use of cleats 20 engaging depressions 21 in the plastic board sidewall also help maintain the board holders 14 in engagement with the two halves of the practice board 12 when they are struck and separate at a center seam 13 with a tongue and groove or similar sturdy but releasable attachment of the two halves along the center seam 13.

The board holder 14 as herein disclosed features a unique handle 22 positioned rearward from cooperatively engaging board slot 16 on handle members 24. The handle 22 in the current best mode provides a grip to the person holding the board holder 14 allowing the holding person to keep the wrists in line with the arms and minimize injuries to the holder from absorbed force. This is accomplished by having the handle 22 shaped with a taper to allow for a proper grip by the hand of the holder as well as encouraging the holder's hand to the proper natural angle in relation to the forearm when gripping the handle 22.

The handle 22 is mounted to the handle mounts 24 which attach to the handle front wall 26 adjacent to the slot 16 has generally rectangular shape about the exterior. However, the top portion 28 of the handle 22 is thicker than the bottom portion 30 of the handle 22 as depicted by D1 and D2.

Employment of a handle 22 that is thus tapered, provides the needed thickness for the upper portion 28 to accommodate the longer fingers and hand portions of a hand of person holding it when gripping the handle 22. The thicker upper portion 28 tapering to the narrow lower portion 30 which accommodates the shorter fingers of a hand, thus allow for an evenly disbursed grip by the holder on the entire handle 22 for a better grip. Tapering the rear handle 22 forms an angled rear wall 31 thus allowing the board 12 to be held substantially normal to the ground while naturally placing the hands and arms of the person holding it, to an inline position to better absorb the force exerted on the practice board 12 to thereby avoid injury from bending of the wrist or impact on bent wrists and arms. It is however anticipated that the device 10 herein described and disclosed could yield substantial improvements to the utility and function of holding practice boards 12 with straight non tapered handles, and while not the best mode, the use of non tapered handles is anticipated.

Accommodation for the use of natural wooden boards is also provided. This is accomplished by the use of practice boards 12 made of wood having depressions 21 formed in their sidewalls to match the shape of the cleat 20 for a frictional engagement thereon, or, through the use of a pointed cleat 21 positioned in slot 16 which has sloped sidewalls 34 or sidewalls distanced from each other a distance substantially equal to or slightly smaller than the thickness of the practice board 12. When used in combination with a real wood board, the cleats 20 when pointed, easily pierce and sink into the side edge of the wood practice board 12 and the sidewalls 34 if tapered or slightly smaller than the diameter of the practice board 12 compress the edge of the board inserted onto the pointed cleat 21 as the board holder 14 is slid onto the side of the wooden style practice board 12.

The device 10 features a kit embodiment having other parts to allow the user to mount the board holders 14 to a practice bag 32 and to a wall or other solid mount thus allowing the user to practice without the aid of a fellow student or teacher.

For mounting the board holders 14 to a punching or heavy bag 36 the kit employs the two board holders 14 with rearward disposed handles 22 which can be cooperatively engaged with a U-shaped clip 38 having a clip slot 39 sized to frictionally engage with the handles 22 thereby providing a means of shaped clip 38 having a clip slot 39 sized to frictionally engage with the handles 22 thereby providing a means of attachment of the board holders 14 to a belt 40 which would be attached about the circumference of the heavy bag 36. This allows the user to break practice boards 12 which are mounted upon the heavy bag 36 providing an excellent target and eliminating the need for a human holder and potential injuries thereto.

The kit embodiment also provides a wall mounted track 42 which employs mounts 44 for the board holders 14 similar to the U shaped clip 38 which engage registered notches 46 on the edge of the track 42. The user thus can move the target board 12 to a number of positions on the track 42 and does not need a human holder.

Finally, the holding kit features a mounting bracket 43 that is attached to a conventional swivel type mount 48 which would attach to the wall or similar surface and would allow the user to mount the board holders 14 attached to the practice board 12 in the board mounts 44 on the mounting bracket 43 and swivel the mounting bracket 43 on its wall mount to provide practice for striking at different angles.

Figure 10:
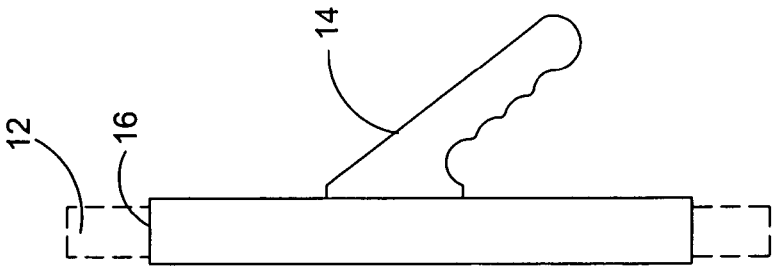
FIG. 10 shows a side view of an embodiment of the device using elongated handles that angle downward from the rear.
Figure 8:
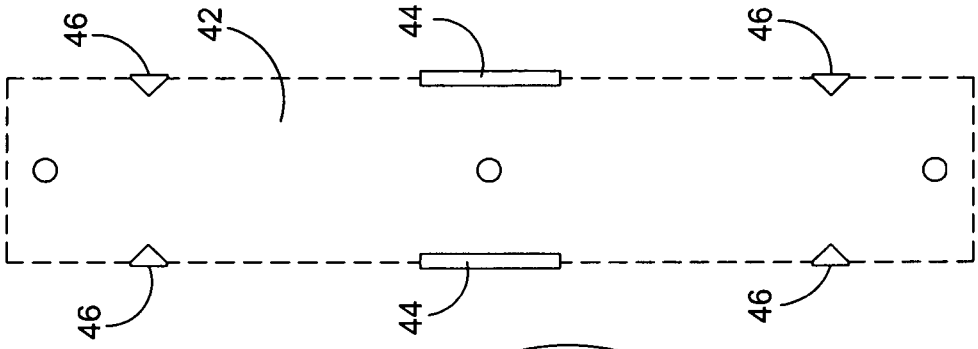
FIG. 8 shows a top view of an elongated track for wall mounting having registered slots for mounting of the board mounts.
Figure 7:
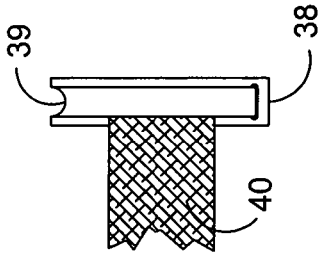
FIG. 7 depicts the U-shaped clips which attach to the handles and the strap used to achieve the bag mount of the board mounts.
Figure 9:
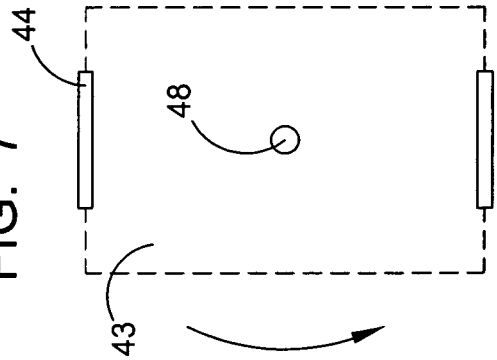
FIG. 9 is a top view of a swivel mounted base for attachment of the board mounts thereon.
Figure 6:
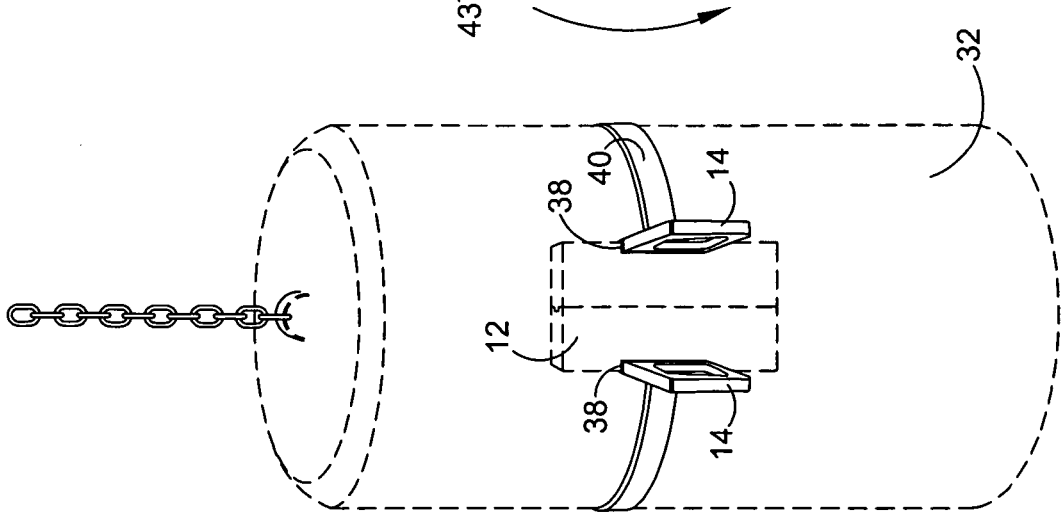
FIG. 6 depicts another embodiment of the device which allows for the pair of herein disclosed board mounts when mounted to the side of a practice board, to be operatively mounted upon a heavy bag.

Finally, as shown in FIG. 10, another means to maintain the hands and wrist in their natural position in relation to the forearm would be achieved by using handles 14 which angle downward from their attachment at the handle front wall 26 adjacent to the slot 16. These elongated handles 14 can also be tapered being thicker at their top portion to allow for the longer fingers of the hand. Also, the downward angle naturally places the hand and wrist of the holder in line with the forearm to better absorb force without injury.

Of course use of the hand-held board holders 14 by themselves are a great improvement to the present art and use of them by themselves or in combination with various kit parts would yield improved function and such individual or combination use is anticipated.

While all of the fundamental characteristics and features of the present invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined by the following claims.

What is claimed is:

1. For use in combination with a martial arts practice board of planar construction and having two side edges of substantially equal thickness, a board holder apparatus comprising:

a pair of handles, each of said handles having a top portion and bottom portion;

each of said handles attached to a front wall by two handle members, each of said two handle members attached at a first end to said front wall and at a second end to a respective said handle;

each of said handles having a handle aperture defined by said handle, said handle members, and said front wall;

each of said handles having a slot positioned at said front wall, said slot having a pair of sidewalls terminating at a bottom wall and an open end opposite said bottom wall; and said sidewalls distanced from each other a distance equal to or slightly less than said thickness of said side edges whereby said sidewalls frictionally engage said practice board in said slot.

2. The board holder apparatus as defined in claim 1 additionally comprising:

said top portion of said handle members having a top diameter and said bottom portion of said handle member having a bottom diameter; and said top diameter being larger than said bottom diameter whereby said handle members taper with said top portion being larger than said bottom portion.

3. The board holder apparatus as defined in claim 1 additionally comprising:

at least one cleat projecting from said bottom wall of each of said slots; and said cleat dimensioned to frictionally engage at least one similarly shaped depression formed in said side edges of said practice board used in combination herewith.

4. The board holder apparatus as defined in claim 2 additionally comprising:

at least one cleat projecting from said bottom wall of each of said slots; and said cleat dimensioned to frictionally engage at least one similarly shaped depression formed in said side edges of said practice board used in combination herewith.

5. The board holder apparatus as defined in claim 1 wherein said sidewalls taper inward toward said bottom wall wherein said slot is narrower at said bottom wall than at said open end.

6. The board holder apparatus as defined in claim 2 wherein said sidewalls taper inward toward said bottom wall wherein said slot is narrower at said bottom wall than at said open end.

7. The board holder apparatus as defined in claim 3 wherein said sidewalls taper inward toward said bottom wall wherein said slot is narrower at said bottom wall than at said open end.

8. The board holder apparatus as defined in claim 4 wherein said sidewalls taper inward toward said bottom wall wherein said slot is narrower at said bottom wall than at said open end.

9. The board holder apparatus as defined in claim 1 additionally comprising:

at least one cleat projecting from said bottom wall of each of said slots;

said cleat having a pointed tip at a distal end opposite said bottom wall; and said cleat puncturing and engaging said side edges of said practice board used in combination herewith when said practice board is engaged in said slots.

10. The board holder apparatus as defined in claim 2 additionally comprising:

at least one cleat projecting from said bottom wall of each of said slots;

said cleat having a pointed tip at a distal end opposite said bottom wall; and said cleat puncturing and engaging said side edges of said practice board used in combination herewith when said practice board is engaged in said slots.

11. The board holder apparatus as defined in claim 9 wherein said sidewalls taper inward toward said bottom wall wherein said slot is narrower at said bottom wall than at said open end.

12. The board holder apparatus as defined in claim 10 wherein said sidewalls taper inward toward said bottom wall wherein said slot is narrower at said bottom wall than at said open end.

13. The board holder apparatus as defined in claim 1 additionally comprising:

a strap having a first end and a second end;

means of attachment of said first end to one of said two handles;

means of attachment of said second end to the other of said two handles; and means to tighten said strap around a punching bag; and whereby said practice board when cooperatively engaged with said handles may be mounted upon a punching bag.

14. The board holder apparatus as defined in claim 2 additionally comprising:

a strap having a first end and a second end;

means of attachment of said first end to one of said two handles;

means of attachment of said second end to the other of said two handles; and means to tighten said strap around a punching bag; and whereby said practice board when cooperatively engaged with said handles may be mounted upon a punching bag.

15. The board holder apparatus as defined in claim 1 additionally comprising:

a track, said track configured for mounting on a wall;

means of attachment of said handles to said track whereby said practice board when cooperatively engaged with said handles may be mounted to said track.

16. The board holder apparatus as defined in claim 2 additionally comprising:

a track, said track configured for mounting on a wall;

means of attachment of said handles to said track whereby said practice board when cooperatively engaged with said handles may be mounted to said track.

17. The board holder apparatus as defined in claim 15 additionally comprising:

a swivel, said swivel attaching said track to said wall in rotational engagement therewith whereby said track and said practice board engaged therewith may be rotated.

18. The board holder apparatus as defined in claim 16 additionally comprising:

a swivel, said swivel attaching said track to said wall in rotational engagement therewith whereby said track and said practice board engaged therewith may be rotated.

19. For use in combination with a martial arts practice board of planar construction and having two side edges of substantially equal thickness, a board holder apparatus comprising:

a pair of handles, each of said handles having a top portion and bottom portion;

each of said handles attached to a front wall at said top portion and extending at a determined downward angle from said front wall and terminating at a distal end;

each of said handles having a slot positioned at said front wall, said slot having a pair of sidewalls terminating at a bottom wall and an open end opposite said bottom wall; and said sidewalls distanced from each other a distance equal to or slightly less than said thickness of said side edges whereby said sidewalls frictionally engage said practice board in said slot.

20. The board holder apparatus as defined in claim 19 additionally comprising:

said handles members tapering in grip size from a larger said top portion to a smaller said bottom portion.

* * * * *